United States Patent [19]

Schaffer, Jr. et al.

[11] 4,133,748

[45] Jan. 9, 1979

[54] MATERIAL SEPARATOR

[75] Inventors: Harry E. Schaffer, Jr., Lewisburg; C. Donald Fisher, Muncy, both of Pa.

[73] Assignee: Koppers Company, Inc., Pittsburgh, Pa.

[21] Appl. No.: 823,092

[22] Filed: Aug. 9, 1977

[51] Int. Cl.[2] ..... B03B 7/00

[52] U.S. Cl. ..... 209/17; 209/159; 209/297; 209/464

[58] Field of Search ..... 209/155, 159, 173, 280, 209/283, 464, 297, 17, 13, 160, 284, 293; 198/670

[56] References Cited

U.S. PATENT DOCUMENTS

| | | | |
|---|---|---|---|
| 532,600 | 1/1895 | Simon | 209/173 X |
| 573,687 | 12/1896 | McDaniel | 219/173 X |
| 1,013,527 | 1/1912 | Burby | 209/17 |
| 1,169,986 | 2/1916 | Middaugh | 209/297 X |
| 1,235,427 | 7/1917 | Bridewell | 198/676 X |
| 1,269,966 | 6/1918 | Shepard | 209/173 X |
| 1,706,292 | 3/1929 | Heyman | 198/670 |
| 2,047,808 | 7/1936 | Trinbey | 209/297 X |

FOREIGN PATENT DOCUMENTS

| | | | |
|---|---|---|---|
| 966449 | 4/1975 | Canada | 209/17 |
| K26497 | 10/1956 | Fed. Rep. of Germany | 209/155 |
| 326986 | 11/1968 | U.S.S.R. | 209/464 |

*Primary Examiner*—Robert Halper

*Attorney, Agent, or Firm*—Herbert J. Zeh, Jr.; Oscar B. Brumback

[57] ABSTRACT

A material separator includes a housing defining a settling chamber, a communicating drain chamber and a discharge member. A horizontal screw conveyor extends through the settling chamber and drain chamber to the discharge chamber. Material to be separated is introduced into the housing at the top of the settling chamber and water is introduced into the bottom of the settling chamber at a flow rate sufficient to partially immerse the conveyor. The heavier material components sink to the bottom of the settling chamber while the desired lighter components float and are advanced by the conveyor and water flow into the drain chamber. In the drain chamber, the horizontal screw conveyor is tapered inwardly as the screw conveyor traverses the discharge chamber and a tapered screen is positioned around the tapered screw conveyor to rotate therewith. This arrangement of the tapered screw conveyor and rotating tapered screen permits an improved separation of the water and fines from the desired stock which is then passed into the discharge chamber.

5 Claims, 4 Drawing Figures

MATERIAL SEPARATOR

BACKGROUND OF THE INVENTION

The present invention relates generally to material separating devices for separating particulate materials of different specific gravities and relates particularly to a device for separating heavier foreign matter from low specific gravity stock such as wood chips and the like. More particularly, this invention relates to an improved drainage chamber for a material separating device.

In the processing of paper pulp, wood chips or sawdust are passed into refiners to break down the material into fibrous pulp for subsequent processing. Prior to the refining operation, foreign matter must be removed from the stock, and the water content of the stock must be as low as possible. One of the conventional prior art apparatus employed for this purpose is described in Canadian Patent No. 966,449. In such apparatus, a housing is provided enclosing a settling chamber, an adjacent drain chamber and a discharge chamber. An agitating and conveying screw passes horizontally through the settling chamber and drain chamber, terminating adjacent the discharge chamber beyond the drain chamber. Means are provided for maintaining a water flow from the lower region of the settling chamber, which water flow continually immerses a portion of the conveyor screw and passes into the drain chamber. Material to be separated is introduced into the upper region of the settling chamber wherein it is washed by the water flow and agitated and conveyed by the water and conveyor toward the drain chamber. A U-shaped screen disposed in the drain chamber serves to separate the fine foreign matter from the stock and also to remove the water from the stock. The stock is then discharged into pulp refining equipment without further treatment.

In the prior art apparatus, the screen means disposed in the drain chamber is generally a U-shaped screen that is supported beneath the screw conveyor. The U-shaped screen is non-movable and is attached to the housing of the drain chamber. Additionally, the screw conveyor of the prior art apparatus is of uniform flight size. The screw conveyor extends from the settling chamber through the drain chamber and to the discharge chamber and is of substantially the same size of flights throughout the length. Although drain chambers having the above configuration will work, they are not as effective as desired. The drainage rate of the material to be pulped is not as efficient as necessary and too much water is discharged into the pulp refining equipment. If the speed of the screw conveyor is slowed down to reduce the amount of water being discharged to the refining equipment, the amount of material to be pulped is reduced to an uneconomical rate.

It is accordingly an object of the present invention to provide an improved material separator for separating materials of different specific gravity. In particular, it is an object of the present invention to provide an improved material separator for separating foreign matter from wood chips, saw dust and other pulping material prior to pulping the material. It is particularly an object of the present invention to provide an improved drain chamber for a material separator for separating materials of different specific gravity.

SUMMARY OF THE INVENTION

The present invention is an improved material separating device for separating particulate materials of different specific gravities particularly for separating heavy foreign materials from pulping stock such as wood chips, sawdust and the like. The material separating apparatus of the present invention has an improved drain chamber that more efficiently separates the water from the desired pulping material. The amount of water discharged into the refining apparatus is greatly reduced because of the improved drainage apparatus of the present invention.

The improved apparatus of the present invention generally comprises a housing defining a settling chamber, a communicating drain chamber and a discharge chamber. The settling chamber extends downwardly from an upper section to a lower section. A material inlet port is located in the upper section of the housing to introduce material to be separated into the upper section of the settling chamber. A rotatably disposed screw conveyor of equal flight extends substantially horizontally through the settling chamber and drain chamber. The screw conveyor is adapted to agitate and convey material from the upper region of the settling chamber through the drain chamber to a discharge port in the discharge chamber. The diameter of the flights of the screw conveyor is constant in the settling chamber. The diameter of the flights immediately increase at the point where the screw conveyor enters the drain chamber and the diameter of the flights is tapered inwardly as the screw conveyor extends across the drain chamber. The diameter of the flights decrease as the screw conveyor gets nearer the discharge chamber. The rate of flow of material through the separating device is controlled by the rate of rotation of the screw conveyor and motor means are used to rotate the screw conveyor. The settling chamber has inlet means in the lower section for introducing water into the settling chamber and means for periodically discharging settled materials from the lower section of the settling chamber. The drain chamber has a screen means adapted to receive the material and liquid advanced from the upper region of the settling chamber. The screen is in the shape of a tapered cylinder and the screen surrounds the screw conveyor and rotates with the screw conveyor. A drain port is located in the drain chamber beneath the screen for discharging from the separator the liquid that is separated from the pulping material by the screen. The pulping material is then discharged to the refining apparatus through the discharge port in the end of the discharge chamber housing.

The improved apparatus of the present invention is a result of the larger diameter tapered screw and rotating basket screen in the drain chamber. The use of a rotating basket screen increases the effective surface area for dewatering by a factor of 3–5 over the prior art stationary screen without extending the length of the separating device. A better separation of water from the pulping material is obtained because of the increase in surface area of the drainage screen and because of the increased agitation provided by the increased area of the flights on the screw conveyor. The larger flights provide better agitation of the slurry and thereby aids water removal. The tapered characteristics of the screw and screen also improve the removal of water. The tapered effect allows the water to run back towards the settling chamber rather than flow out of the discharge port with the wood chips.

The invention may be more readily understood from the following detailed description of embodiments thereof especially in view of the accompanying drawings wherein.

Figure 1:
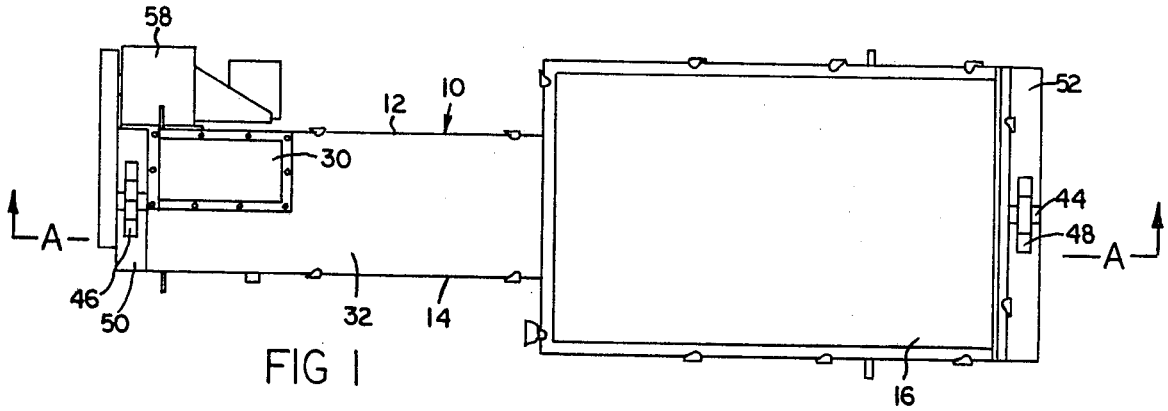
FIG. 1 is a plan view of a material separator in accordance with the present invention.

Referring to the drawings, a material separator 10 embodying the present invention includes a housing 12 defining therewithin a settling chamber 14 and a communicating drain chamber 16. The settling chamber 14 is of a substantially rectangular horizontal section in its upper region 18 and extends downwardly in a hopper shaped lower portion 20 which funnels into a vertical cylindrical waste pipe 22 at its lower end.

The drain chamber 16 communicates with the settling chamber 14 by means of the U-shaped housing portion 24. The drain chamber 16 is longitudinally aligned with the rectangularly shaped upper section 18 of the settling chamber and similarly has a tapered rectangularly shaped horizontal section. The drain chamber 16 includes a downwardly extending hopper bottom 26, the walls of which converge toward a drain port 28.

An inlet port 30 in the cover 32 of the settling chamber 14 may be coupled to an inlet conduit 34 through which material to be treated passes into the upper region 18 of the settling chamber. Located at the opposite end of the housing, beyond the drain chamber 16, is the discharge chamber 36 having a discharge port 38 in the bottom thereof connected to the discharge duct 40.

Figure 4:
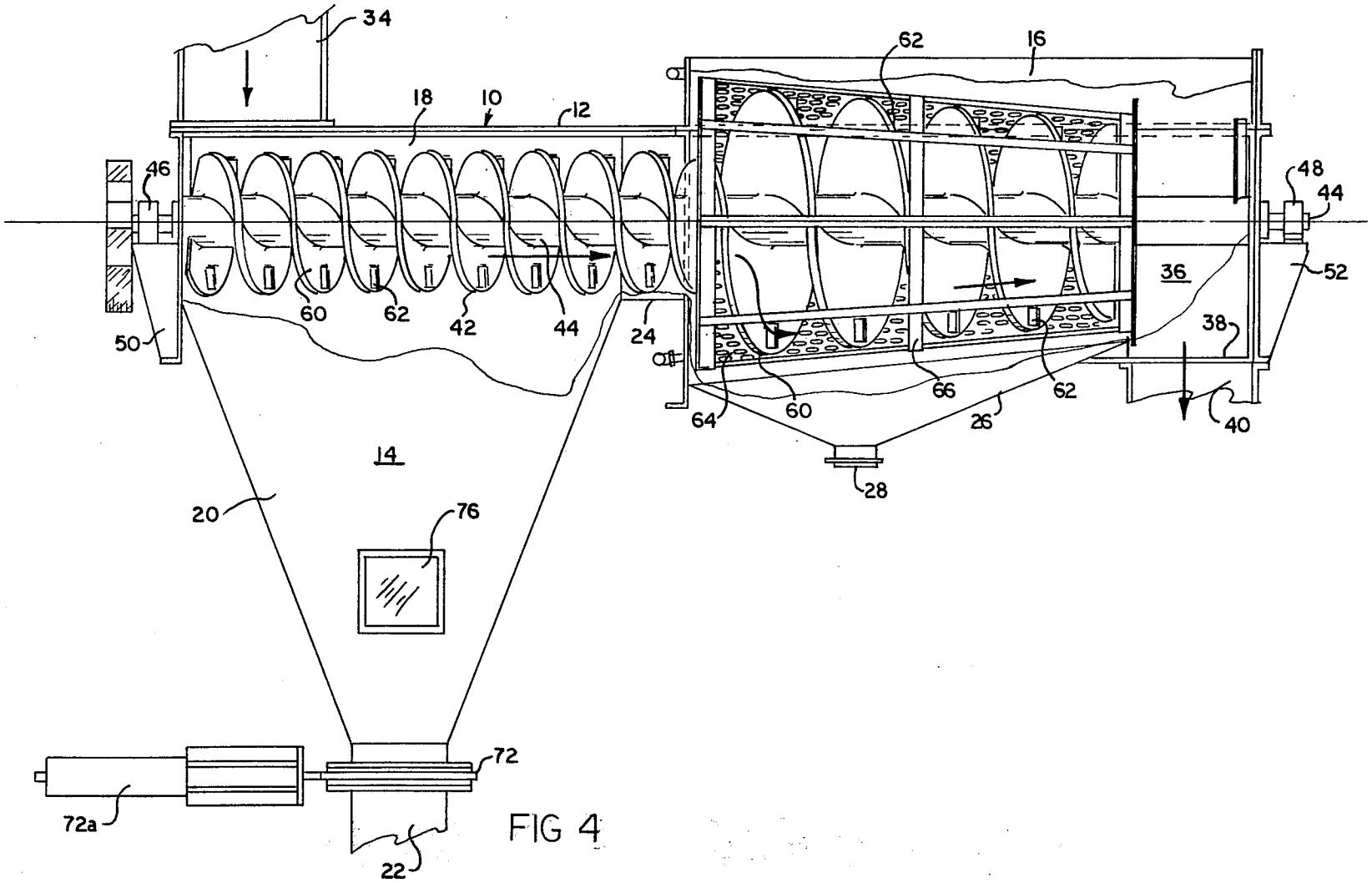
FIG. 4 is an enlarged partial sectional view taken along line AA of FIG. 1 and showing interior details of the material separator.

Referring to FIG. 4, a conveyor screw 42 extends longitudinally through the housing, passing through the upper region 18 of the settling chamber, the connecting portion 24 of the housing, the drain chamber 16 and terminating adjacent the discharge chamber 36. The conveyor screw 42 is mounted on a shaft 44 which is journaled by bearings 46 and 48 respectively mounted on bearing supports 50 and 52 at opposite ends of the housing. A drive sprocket secured to one end of the shaft 44 is operatively connected by a roller chain drive to an electric gear motor 58 secured exteriorly of the housing. The motor is operable to rotate the conveyor screw 42 at a predetermined rate in a direction which will advance material from the settling chamber 14 through the drain chamber 16 and into discharge chamber 36.

Conveyor screw 42 has flights 60 of equal pitch as it extends from the settling chamber through the drain chamber. It is within the scope of this invention to have flights of different pitches in the settling chamber and drain chamber. The flights 60 have a plurality of baffles 62 projecting from the surface thereof to increase the agitation action. One or more baffles may be located on each flight. The baffles may also be located on the flights in the drainage section and it is preferred to have baffles on the flights in the drainage chamber. The baffles are spaced along the outer edge of the screw flight.

The diameter of the flights are constant across the settling chamber. Immediately after the screw conveyor enters into the drainage chamber, the diameter of the flights are increased substantially. The diameter is preferably increased by a factor of 2 times the flight diameter in the settling chamber. The diameter is then decreased as the screw conveyor traverses the drainage chamber. The screw conveyor in the drain chamber is tapered inwardly as it approaches the discharge chamber. The screw conveyor is preferably a solid flight but other types may be employed with a decrease in effectiveness.

As shown in FIG. 4, a screen 64 is positioned in the drain chamber to receive the flow of pulping material and water for the purpose of draining the water from the pulping material. The water passes through screen 64 into the hopper bottom 26 of drain chamber 16 from which it is discharged through drain port 28. Screen 64 is in the shape of a tapered cylinder or truncated cone and is mounted on conveyor flights 60. Screen 64 is tapered inward as the conveyor approaches the discharge chamber and has the same degree of tapering as the screw conveyor. The screen is mounted on flights 60 and rotates with conveyor screw 42. Screen 64 is rigidly supported by grid structure 66 and grid structure 66 is affixed to flights 60.

The rotatably mounted cylindrically tapered screen provides a larger surface area for draining action than the prior art U-shaped screen. A better separation of water from the chips is obtained with the larger surface area of the screen. The increased tumbling volume with an increase in agitation resulting from the larger flight diameter also aids in the removal of water from the desired pulping material. The inward tapering of both the screw conveyor and the draining screen greatly improve the draining efficiency of the apparatus of the present invention. The inward tapering results in a constant upward pitch of the bottom of the screen and screw across the drainage chamber. This upward pitch keeps the water from draining out into the discharge port and provides for more efficient water removal. The degree of tapering is important. The degree of pitch across the drain chamber should not be so steep as to cause the pulping material to roll back and jam up, but should be steep enough to allow the water to run back. In order to permit the water to run back, it is desirable to have at least about ⅜ inch clearance between the screen and the flights of the screw conveyor. If a clearance is not provided for, the water will pond or collect between the screw flights and will not be allowed to run back and will be discharged into the refining system along with the pulping material. If too much clearance is allowed, the pulping material may bind up. The flights in the screw conveyor, particularly the first few flights in the drain chamber, may have perforations along the outer edge thereof to prevent ponding and to allow the water to drain back more readily. Increasing the diameter of the screw conveyor and screen increases the volume with a subsequent increase in retention time thereby improving water removal. Water removal is further improved by tapering the screw conveyor and screen.

Figure 2:
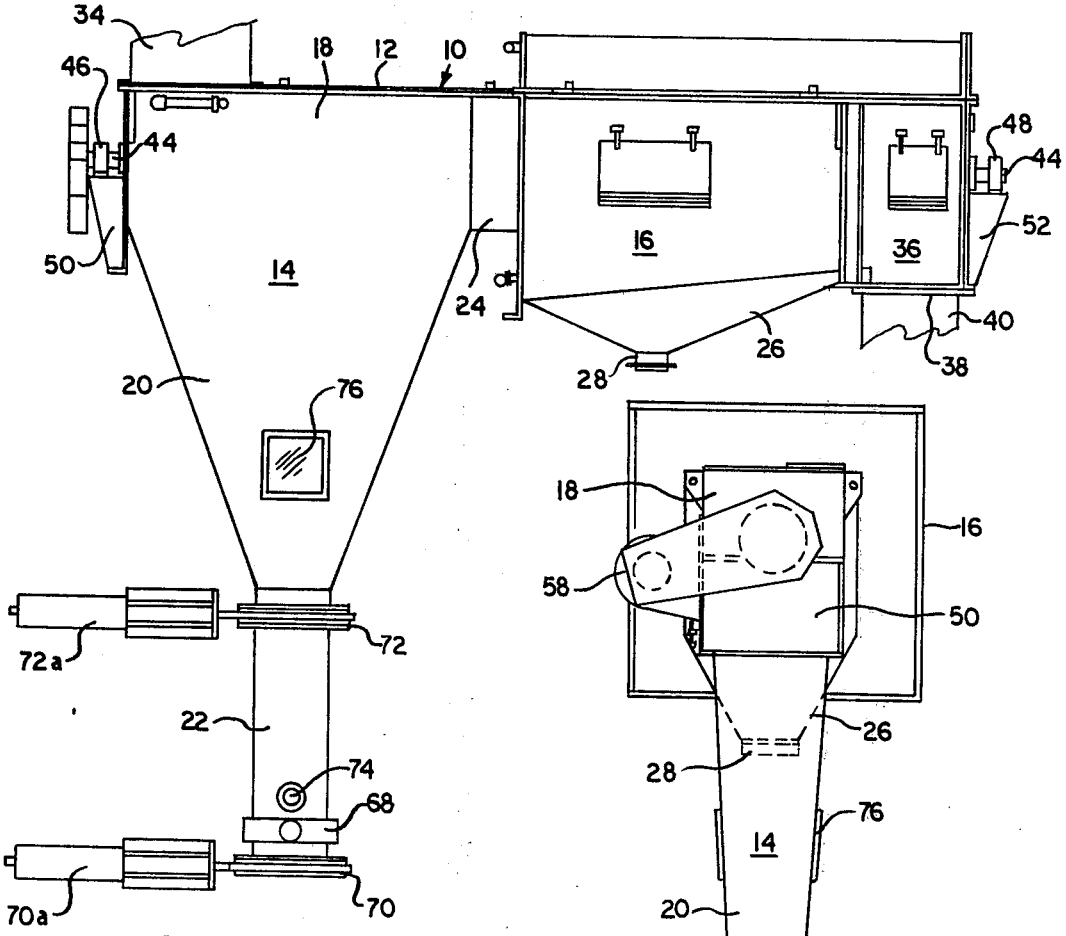
FIG. 2 is a side elevational view of the material separator of FIG. 1.
Figure 3:
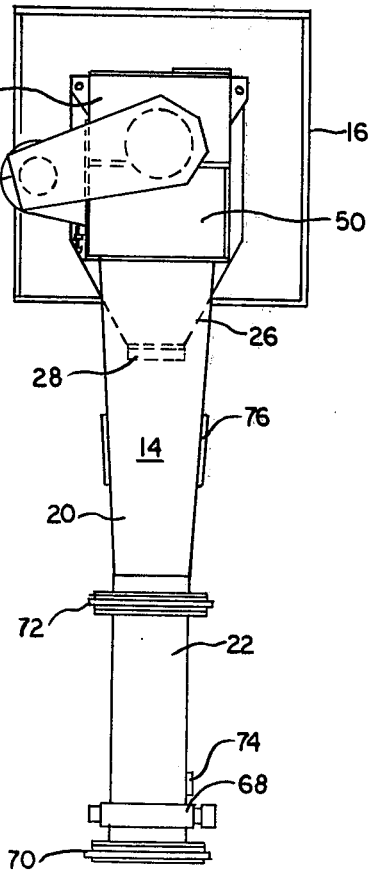
FIG. 3 is an end elevational view of the separator of FIG. 1.

Referring to FIGS. 2 and 3, means are provided for introducing a flow of water into the lower region of the settling chamber. Said means may comprise an annular conduit 68 encircling the waste pipe 22 and which communicates with the interior of the waste pipe by means of a plurality of spaced ports in the wall thereof. Conduit 68 and openings thereinto are adapted for connection with a source of water under pressure.

A gate valve 70 at the lower end of the waste pipe 22 normally closes the bottom of the settling chamber and permits foreign matter to accumulate within the waste pipe and the hopper portion 20 of the chamber. A second gate valve 72 toward the upper end of the waste pipe permits an emptying of the waste pipe periodically to discharge accumulated foreign matter. To carry out this operation, the gate valve 70 is opened by the actuator **70*a* while the gate valve 72 is closed by actuator 72*a* for a short time to allow gravity discharge of debris accumulated between the two valves. Valve 70 is then closed and valve 72 opened to resume the normal operation of the settling chamber. Sight glasses 74 and 76** respectively located in the waste pipe and the hopper portion of the settling chamber allow the machine operator to observe the accumulation within these portions of the device.

For operation of the device, the annular conduit 68 is connected to a pressurized source of water and the lower end of the waste pipe 22 as well as the drain port 28 are positioned over or connected with suitable receptacles respectively for the separated materials and the drain water. The water from the port 28 may be recycled following suitable treatment to remove entrained particulate matter. The inlet duct 34 and discharge duct 40 may be connected to the apparatus in the manner illustrated in FIG. 2 so that a continuous material separation operation may be carried out.

With the gear motor 58 operating to rotate the screw conveyor at a predetermined speed, the flow of material into the device as well as the flow of water up through the settling chamber are regulated so that water flows from the settling chamber into the drain chamber with the conveyor screw in the settling chamber being partially immersed in the water. The rotation of the screw in the upper region of the settling chamber agitates the material, and assisted by the flow of water around the screw, provides a separation of heavier material components such as sand, metal or stone particles which will drop into the lower region of the settling chamber and ultimately the waste pipe 22. The remaining stock passes through the region 24 of the housing and into the drain chamber 16 wherein the water is separated from the stock as the stock is moved by the conveyor screw through the drain chamber. The water and fine particulate matter drops through the screen and passes out through the drain port 28 while the stock is conveyed to the end of the drain chamber and into the discharge chamber 36 from which it drops by gravity through the discharge port 38.

The waste pipe 22 may, as indicated above, be periodically emptied by closing the normally open gate valve 72 and opening the normally closed gate valve 70, whereby accumulated debris within the pipe will drop by gravity from the pipe into a suitable container. After the pipe has been so emptied, the valves are reversed to their normal operating positions. The sight glasses 74 and 76 may be utilized to monitor the accumulation of material so that the reversal of the valves may be scheduled only when needed. If desired, automatic timing devices could be employed to reverse the valves at predetermined time intervals and thus automatically evacuate the separated materials from the settling chamber.

What is claimed:

1. An improved separator of the type comprising a housing, said housing defining a settling chamber, a communicating drain chamber and a discharge chamber, said settling chamber extending downwardly from an upper region to a lower region, a material inlet port in said housing for introducing material to be separated into the upper region of said settling chamber, a rotatably disposed conveyor screw extending substantially horizontally through said settling chamber and said drain chamber and adapted to agitate and convey material from the material inlet port through the upper region of said settling chamber and through said drain chamber to said discharge chamber adjacent said drain chamber, means for rotating said conveyor screw at a predetermined rate, means in said settling chamber for introducing a liquid into the lower region of said settling chamber, means for periodically discharging settled materials from the lower region of said settling chamber, a screen disposed in said drain chamber to separate the material and liquid advanced from the upper region of said settling chamber by said screw conveyor, a drain port in said drain chamber beneath said screen for discharge from said housing of liquid passing through said screen, and a discharge port in said discharge chamber for discharging material from the housing wherein the improvement comprises using a screw conveyor that increases in flight diameter at the point where said screw conveyor enters said drain chamber and where said flight diameter decreases as said screw conveyor extends across said drain chamber and using a tapered cylindrical shaped screen that is mounted on said screw conveyor to rotate with said screw conveyor.

2. An improved separator as in claim 1 wherein the screw conveyor has a plurality of baffles spaced along the outer edges of the screw flights.

3. An improved separator as in claim 1 wherein the flights increase in diameter by a factor of at least about two.

4. An improved separator as in claim 1 wherein the screen is attached to the ends of the flights.

5. An improved separator as in claim 1 wherein a clearance of at least $\frac{3}{8}$ inch is provided between the flights in the drain chamber and the screen.

* * * * *